US006901726B2

(12) United States Patent
Hüppi et al.

(10) Patent No.: US 6,901,726 B2
(45) Date of Patent: Jun. 7, 2005

(54) METHOD AND APPARATUS FOR PUTTING PIECE GOODS INTO CONTAINERS

(75) Inventors: Emil Hüppi, Uhwiesen (CH); Peter Dübendorfer, Zürich (CH); Frank-Peter Kirgis, Neuhausen am Rheinfall (CH); Markus Sidler, Hemmental (CH); Jacob Van Kogelenberg, Stein am Rhein (CH); Stephan Schüle, Schaffhausen (CH)

(73) Assignee: Robert Bosch GmbH (DE)

( * ) Notice: Subject to any disclaimer, the term of this patent is extended or adjusted under 35 U.S.C. 154(b) by 0 days.

(21) Appl. No.: 10/402,211

(22) Filed: Mar. 28, 2003

(65) Prior Publication Data

US 2003/0182898 A1 Oct. 2, 2003

(51) Int. Cl.[7] ..... B65B 5/10

(52) U.S. Cl. ..... 53/473; 53/244; 53/250; 53/251; 53/253

(58) Field of Search ..... 53/473, 55, 244, 53/243, 250, 251, 253

(56) References Cited

U.S. PATENT DOCUMENTS 4,907,398 A * 3/1990 Holze et al. ..... 53/443
5,477,663 A * 12/1995 Smith et al. ..... 53/475
5,501,064 A * 3/1996 Ingram et al. ..... 53/473
5,771,657 A * 6/1998 Lasher et al. ..... 53/55
6,438,928 B1 * 8/2002 Huang et al. ..... 53/473
2001/0049923 A1 * 12/2001 Huppi et al.
2003/0150193 A1 * 8/2003 Gasser et al.

FOREIGN PATENT DOCUMENTS

| | | |
|---|---|---|
| DE | 298 17 239 | 9/1998 |
| EP | 0 856 465 | 1/1997 |
| FR | 2 754 239 | 10/1996 |

OTHER PUBLICATIONS

European Search Report in the corresponding Patent Application No. 03405198.7.

* cited by examiner

*Primary Examiner*—Rinaldi I. Rada
*Assistant Examiner*—Gloria R. Weeks
(74) *Attorney, Agent, or Firm*—Harness, Dickey & Pierce, P.L.C.

(57) ABSTRACT

In a method for inserting piece goods (S) into containers (B) by a picking line, the relative speed between the feed of the containers (B) and the feed of the piece goods (S) is controlled in the area of the picking line. In this case, the relative speed is controlled as a function of a filling level of at least one storage element (3, 3', 3", 4). This method permits efficient transfer of piece goods into containers with the most complete filling possible of the containers, irrespective of the manner of the relative transport direction of the piece goods and containers. It is suitable both for cocurrent and for countercurrent systems.

13 Claims, 4 Drawing Sheets

METHOD AND APPARATUS FOR PUTTING PIECE GOODS INTO CONTAINERS

TECHNICAL FIELD

The invention relates to a method and an apparatus for putting piece goods into containers.

PRIOR ART

A generic method is disclosed by EP-A-0 856 465. Here, piece goods and containers are guided along a picking line in countercurrent. In this case, the relative speed of the piece goods supplied to the containers supplied is controlled by the controller of the last picker, in the conveying direction of the containers, in such a way that only completely filled containers leave the working area of this last picker. This method has the disadvantage that the piece goods and containers have to be supplied in countercurrent. However, since packaging systems have to be integrated into the overall production circuit, this very severely restricts the physical configuration of the system.

In addition, EP-A-0 749 902 discloses a method of putting piece goods into containers in which the piece goods and containers are transported in cocurrent along a picking line. Here, the piece goods supplied are counted by a counting device. The empty containers are backed up upstream of the picking line. Only when a number of pieces sufficient to fill a container has been reached is in each case an empty container released into the working area of the pickers.

A further apparatus for putting piece goods into containers by means of pickers, delta robots here, is described in EP-A-1 160 166. Here, too, the attitude and position are registered by means of an optical registration station, notified to the controller of the individual pickers, and the piece goods are put into the containers individually by means of the gripping apparatus of the pickers.

These known systems have the disadvantage that they relatively quickly reach limits with regard to their achievable packaging performance.

SUMMARY OF THE INVENTION

It is therefore an object of the invention to provide a method and an apparatus for putting piece goods into containers which permit an increase in the packaging performance.

This object is achieved by a method and an apparatus having the features of patent claim 1 and, respectively, 10.

According to the invention, a storage element is used and the relative speed between a container conveyor and a piece goods conveyor is controlled as a function of this storage element.

In a simple variant of the method, the relative speed remains constant until a maximum storage capacity has been reached. In a preferred variant of the method, the relative speed is adapted even before this capacity is reached. The speed of the supply of the containers into the area of the picking line or the individual pickers is preferably controlled. In another variant, only the speed of supply of the piece goods into the aforementioned area is controlled, or both speeds are controlled.

In one embodiment, the storage element is used for storing piece goods, in other embodiments it is used for storing containers.

The storage element is preferably arranged upstream of a last picker in the conveying direction of the containers. The speed of a conveying section of the container conveyor in the area of this last picker is controlled as a function of the capacity of this last picker in preferred embodiments. However, it is also possible not to control the speed in this area and to operate the conveying section at constant speed.

With the method and the apparatus according to the invention, with a relatively high packaging performance, it is possible to achieve the situation where the containers are always completely filled. In addition, it is possible for all the piece goods always to be packed.

Further advantageous variants of the method and advantageous embodiments emerge from the dependent patent claims.

BRIEF DESCRIPTION OF THE DRAWING

In the following text, the subject of the invention will be explained by using preferred exemplary embodiments, which are illustrated in the appended drawing, in which.

WAYS OF IMPLEMENTING THE INVENTION

Figure 1:
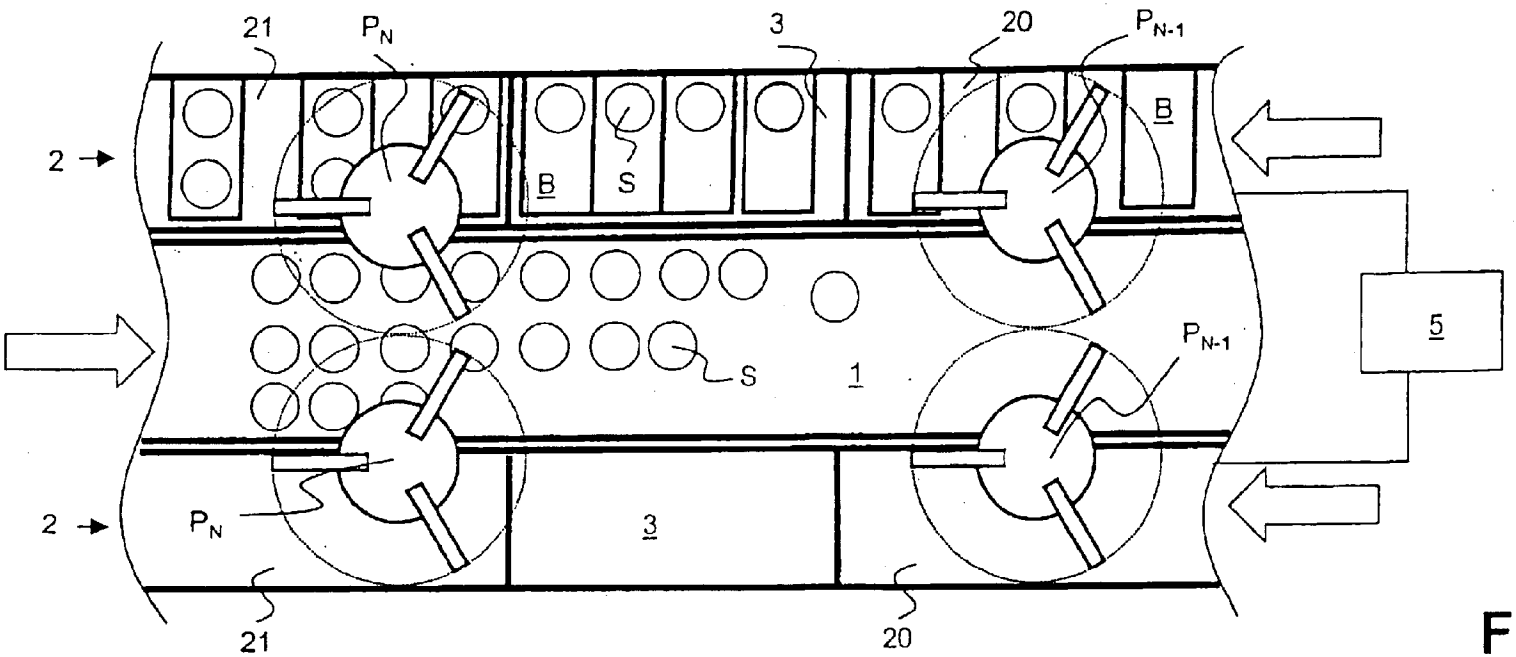
FIG. 1 shows a schematic representation of an apparatus according to the invention in a first embodiment.

The general fundamentals of the apparatus according to the invention will be described by using the first embodiment illustrated in FIG. 1. The apparatus has a first feed conveyor 1 for feeding piece goods S. The feed conveyor 1 is preferably a conveyor belt. However, other conveyor types are also possible. The piece goods S are generally supplied in a disordered formation on the first feed conveyor 1. In this case, there is usually at least one optical registration station, not illustrated here, to detect the attitude and/or orientation of the individual piece goods S, as is known from the prior art. If they are supplied in an ordered fashion, the optical registration station is rendered superfluous or is used merely for quality control.

In addition, there is at least a second feed conveyor 2 for feeding containers B. Illustrated here are two feed conveyors 2, which in each case extend along one side of the first feed conveyor 1 and extend at least approximately parallel to the latter. However, it is also possible for them to be at an angle thereto. The second feed conveyors can likewise be belt conveyors or other known types of conveyors, depending on the type of containers. In the example illustrated here, the conveying directions of the first and second feed conveyors may be represented by antiparallel vectors, which means that the piece goods S and containers B are transported in countercurrent. The conveying directions are in each case identified by large arrows in the figures.

The apparatus also has a picking line with a plurality of pickers $P_N$, $P_{N-1}$. Only four pickers are illustrated here, in each case two placing the piece goods S into the container B belonging to a second feed conveyor 2. However, a plurality of pickers are normally arranged one after another in the conveying direction. The pickers $P_N$, $P_{N-1}$ have gripping means for grasping the piece goods S from the first feed conveyor 1 and depositing the piece goods S in the containers B. Depending on the transfer desired, the piece goods S are grasped individually or in groups and transferred into the containers B. These pickers are known from the prior art. What are known as delta robots, for example, are suitable.

According to the invention, the apparatus additionally comprises a storage element which temporarily stores containers B which have not yet been filled completely and/or piece goods S. In the example illustrated here, this storage element is used for the temporary storage in the picking line of containers B which cannot yet be filled completely. For this purpose, the second feed conveyor 2 is subdivided into at least two conveying sections 20, 21. Two different conveying sections 20, 21 are preferably assigned at least to the last and penultimate pickers $P_N$, $P_{N-1}$ in the conveying direction of the containers B. In each case, a storage element in the form of a separately driven intermediate conveyor 3 is arranged between these conveying sections 20, 21. This intermediate conveyor 3 preferably forms an extension to the conveying sections, so that the containers B can be backed up therein until the last picker $P_N$ has sufficient capacity to completely fill the containers B arriving on the second conveying section 21. The intermediate conveyor 3 can be of the same conveyor type as the second conveyor 2, the containers B being held back and therefore backed up on the intermediate conveyor 3 by retaining means. In one variant, what is known as a yoyo store is used. However, it is also possible to use a transport system for the second feed conveyor 2 and also for the intermediate conveyor 3 in which each container B is provided with its own motor and can therefore be controlled individually. This enables movement and storage in the transport system without contact and without static pressure.

Within the storage element, here the intermediate conveyor 3, the number of containers B is detected and monitored by means of position sensors and/or distance measuring means. These sensors and means are known and will therefore not be described in detail.

The relative speed between the first and the second feed conveyor 1, 2, in this case between the first feed conveyor 1 and the first conveying section 20, is controlled as a function of the storage element, according to the invention. A control unit 5 present for this purpose is illustrated merely schematically in FIG. 1. Control units for conveyor speeds are known per se and will therefore not be described in detail. The relative speed is preferably controlled even before the maximum capacity of the storage element has been reached. The speed of the second conveying section 21 is preferably controlled as a function of the last picker $P_N$. In this way, it is additionally possible to ensure not only that all the containers B are completely filled but that also at least approximately all the piece goods S are deposited in containers B. In one preferred embodiment, the control unit 5 also receives signals from at least one picker, preferably the last picker, which are taken into account in the control.

Figure 2:
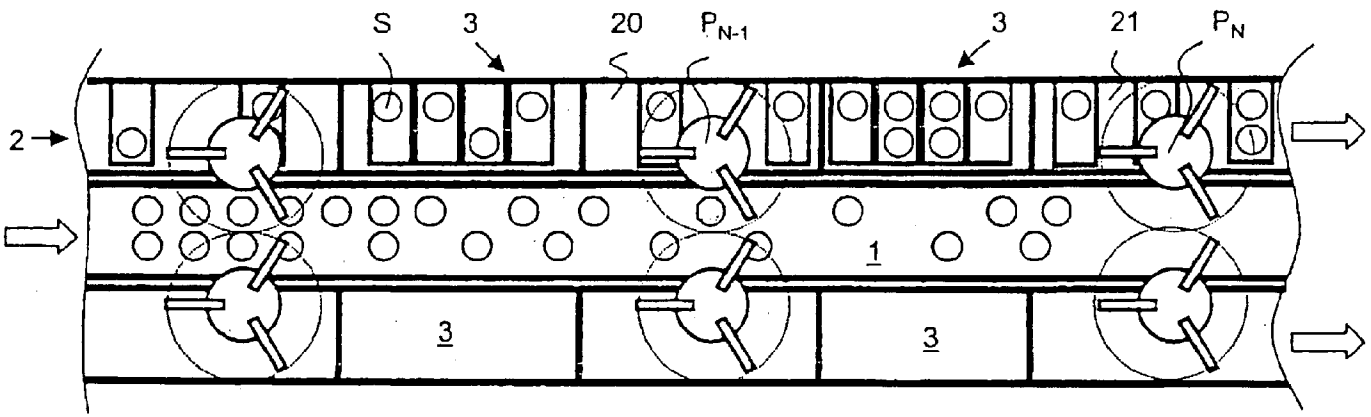
FIG. 2 shows a schematic representation of an apparatus according to the invention in a second embodiment.

A second embodiment is illustrated in FIG. 2. It has substantially the same features as the embodiment according to FIG. 1. However, here the conveying directions of the first and of the at least one second feed conveyor 1, 2 run parallel to one another, that is to say in cocurrent.

Figure 3:
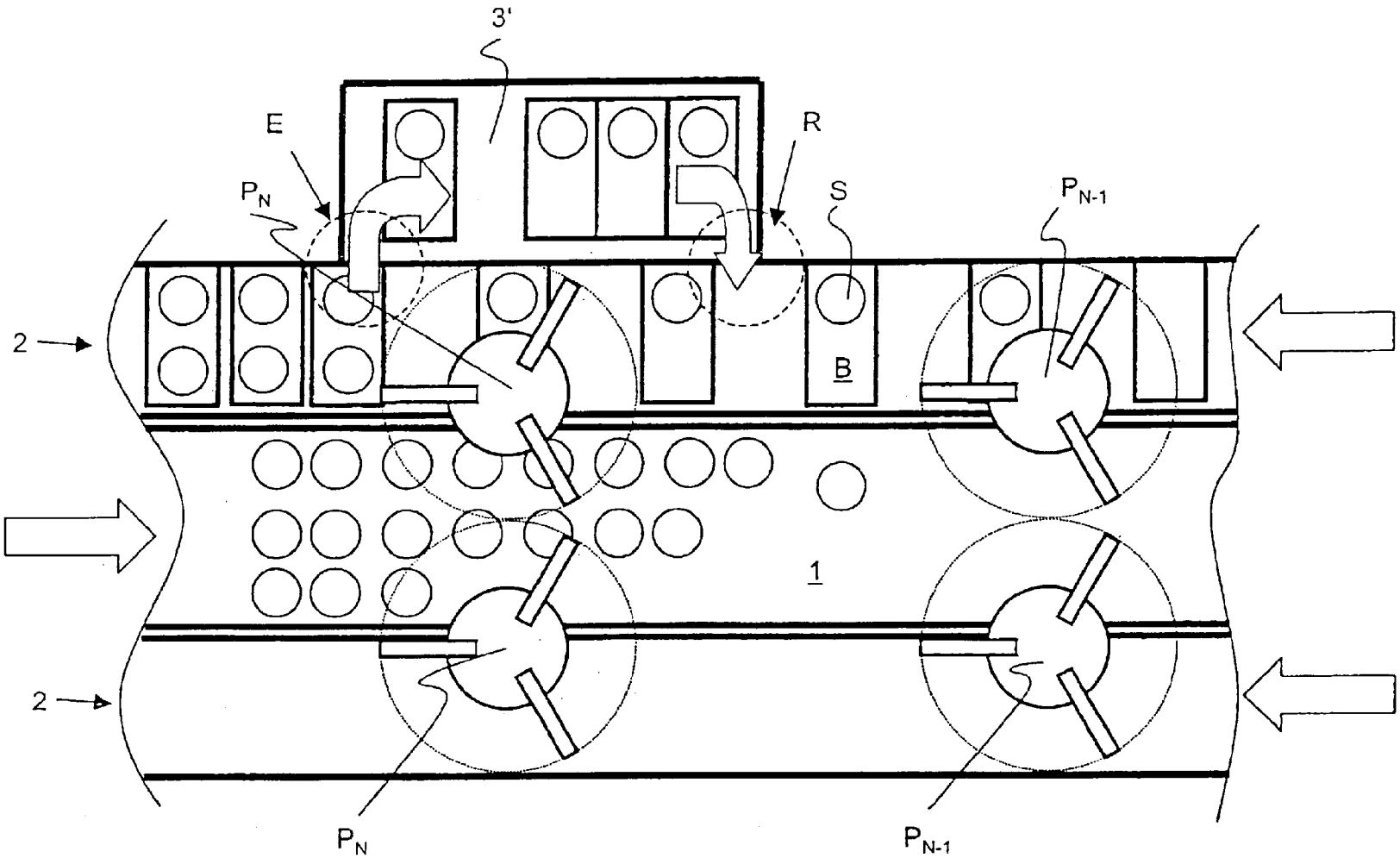
FIG. 3 shows a schematic representation of an apparatus according to the invention in a third embodiment.
Figure 4:
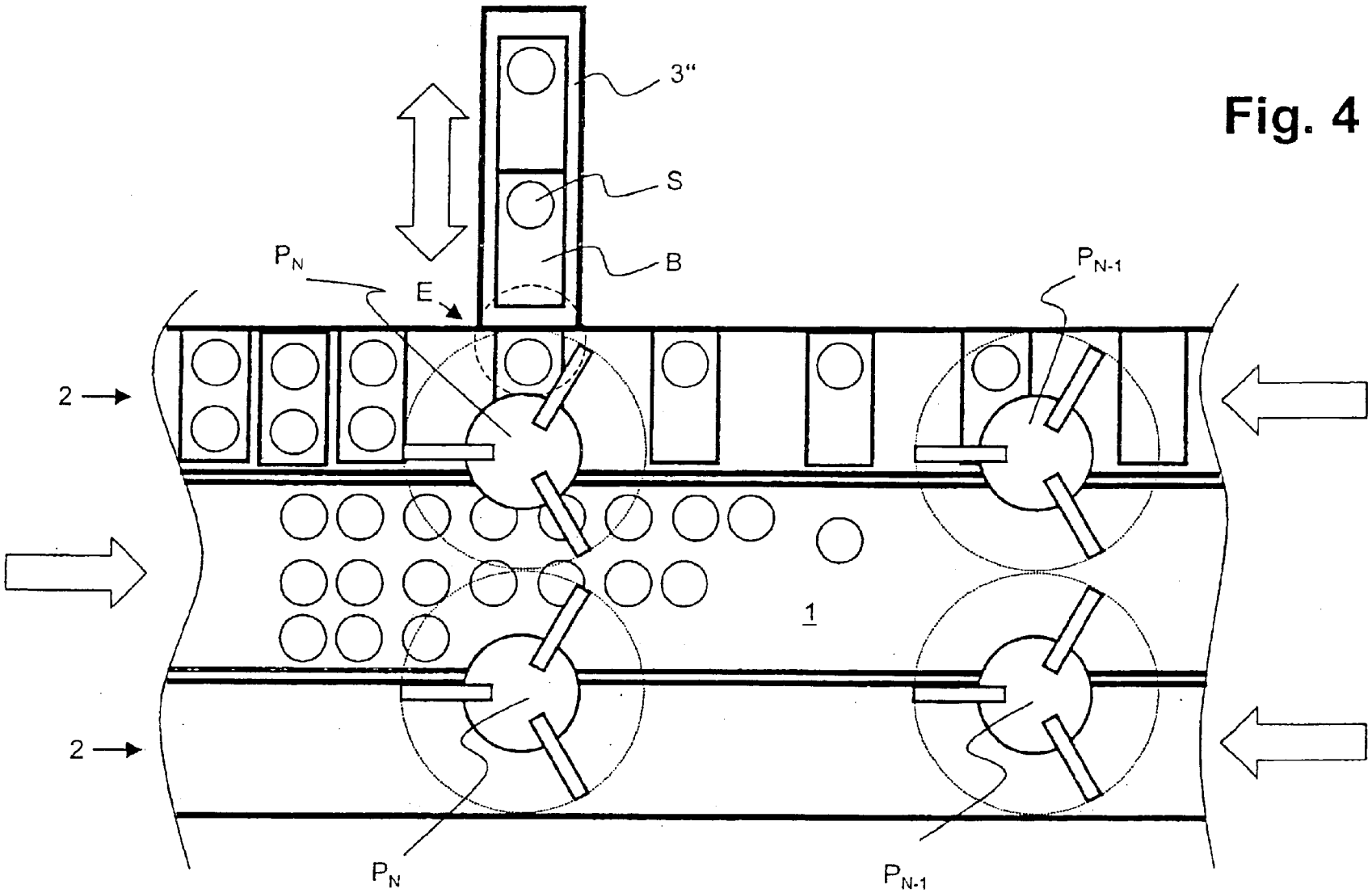
FIG. 4 shows a schematic representation of an apparatus according to the invention in a fourth embodiment and FIG. 5 shows a schematic representation of an apparatus according to the invention in a fifth embodiment.

Further embodiments are illustrated in FIGS. 3 and 4. Here, the storage element is arranged outside the conveying direction of the containers B. This arrangement may be used both in systems with cocurrent and with countercurrent conveyance. In the exemplary embodiment according to FIG. 3, the storage element is a reverse conveyor 3', which runs at least approximately parallel to the second feed conveyor 2. At a removal point E, those containers B which cannot be filled completely are led onto the reverse conveyor 3'. Once there is sufficient capacity in the picking line again, these temporarily stored containers B are placed on the second feed conveyor 2 again at a return point R. The return point R is in this case upstream of the removal point E in the conveying direction of the containers B. Here, too, the relative speed of the two feed conveyors is again controlled as a function of the storage capacity. The intermediate conveyor 3' is preferably arranged in the area of the last picker $P_N$ in the conveying direction of the containers B. It can again be a conveyor belt or another conveyor suitable for the transport of the containers B. A transport system with individually driven containers B is also possible here. The reverse conveyance on the second feed conveyor 2 is carried out in accordance with the first in/first out principle. This embodiment is therefore also suitable for packing frozen, refrigerated or otherwise perishable piece goods S.

In the embodiment according to FIG. 4, the storage element is a container storage conveyor 3" running at least approximately at right angles to the second feed conveyor 2. Said storage conveyor 3" conveys the containers B which cannot yet be filled completely away from a removal point E from the second feed conveyor 2 and back again to this removal point E. The removal point E is preferably in the area of the last picker $P_N$ in the conveying direction of the containers B. Here, too, again various types of conveyors can be used as the storage element. The conveyor is preferably provided with a reversible drive, so that the piece goods S can be kept as far as possible in the area of the removal point E. This storage element functions in accordance with the first in/last out principle.

Figure 5:
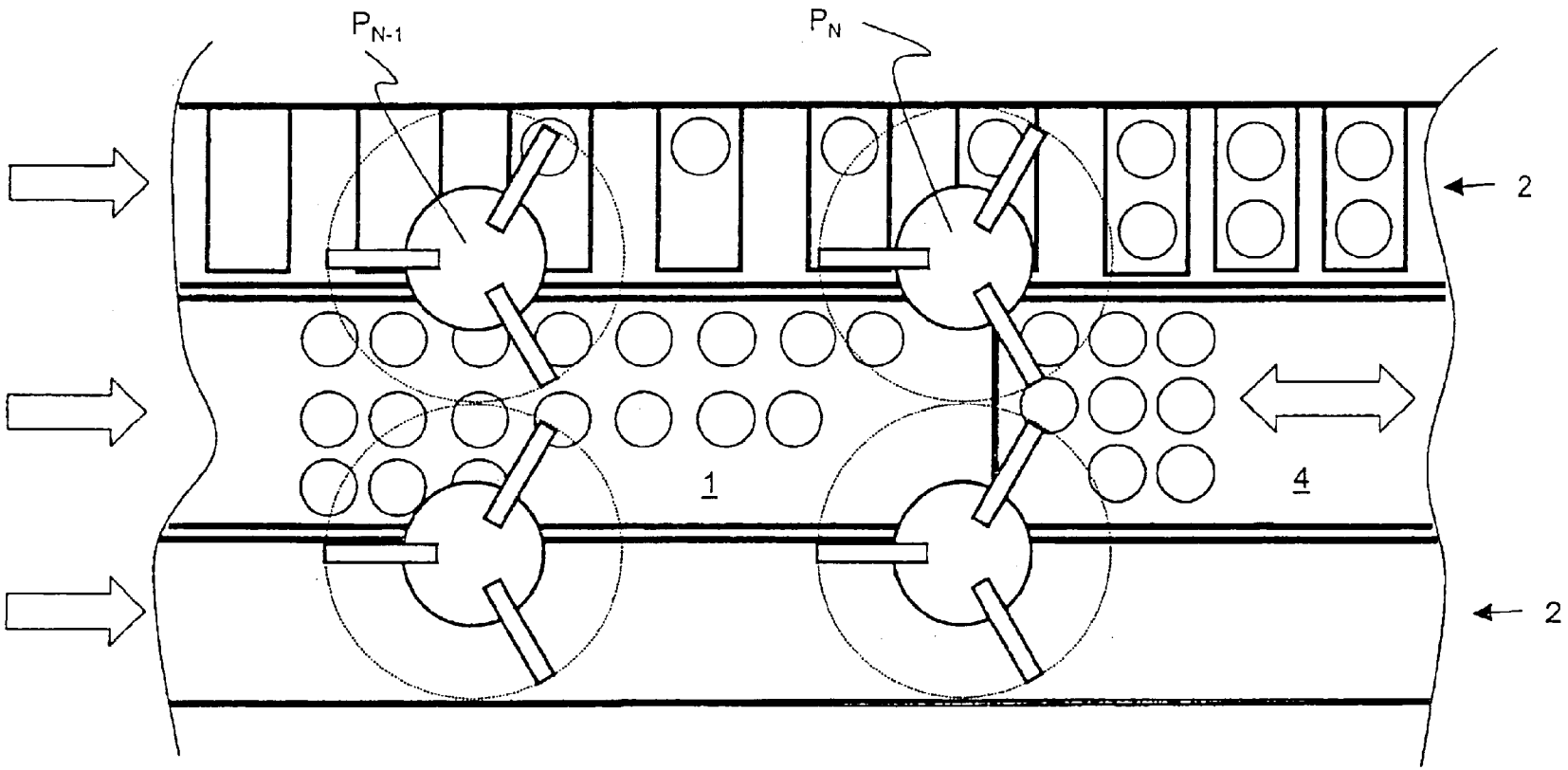

A fifth embodiment is illustrated in FIG. 5. Here, not only the containers B but also the piece goods S are temporarily stored. In this embodiment, the first and the at least one second feed conveyor 1, 2 now run parallel to each other, the piece goods S and containers B being transported in cocurrent. At the end of the first feed conveyor 1 that is arranged downstream, there is a storage element in the form of a piece goods storage conveyor 4. This runs at least approximately parallel to the conveying direction of the piece goods S and thus forms the extension to the first feed conveyor 1. It preferably comprises the same conveyor type as the first feed conveyor 1, for example it is a conveyor belt. However, it is driven separately. Its drive is preferably reversible in this case, so that the piece goods S remain as far as possible in the working area of the last picker $P_N$. In the event of a lack of piece goods S on the first feed conveyor 1, the temporarily stored piece goods S are taken by the last picker $P_N$ in order to fill the containers B completely. Here, too, the relative speed of the two feed conveyors is again controlled as a function of the storage capacity.

Combinations of the aforementioned embodiments are possible. For example, both piece goods S and containers B can be temporarily stored in the same system. It is also possible to arrange storage elements along the picking line and not just in the area of the last picker.

The apparatus according to the invention permits efficient transfer of piece goods into containers with the most complete filling possible of the containers, specifically independently of the manner of the relative transport direction of the piece goods and containers in relation to one another. Said apparatus may be integrated in particular into cocurrent and countercurrent systems.

LIST OF DESIGNATIONS

S Piece goods
B Containers $P_N$ Last picker
$P_{N-1}$ Penultimate picker
E Removal point
R Return point
1 First feed conveyor
2 Second feed conveyor
20 First conveying section
21 Second conveying section
22 Third conveying section
3 Intermediate conveyor
3' Reverse conveyor
3" Container storage conveyor
4 Piece goods storage conveyor
5 Control unit

What is claimed is:

1. An apparatus for inserting piece goods into containers, comprising:

a first feed conveyor for feeding the piece goods;

a second feed conveyor for feeding the containers;

a picking line for inserting the piece goods into the containers;

a control unit for controlling the relative speed between the second feed conveyor and the first feed conveyor;

at least one storage element for temporarily storing the containers and/or the piece goods, wherein the control unit controls the relative speed as a function of a filling level of the at least one storage element; and wherein the second feed conveyor is subdivided into at least two conveying sections a second of said at least two conveying sections being arranged downstream of a first of said at least two conveying sections, and wherein at least one storage elements of the at least one is arranged between the first and second conveying sections.

2. The apparatus as claimed in claim 1, wherein the at least one storage element is arranged in the area of the picking line.

3. The apparatus as claimed in claim 1, wherein the at least one storage element is a conveying element.

4. The apparatus as claimed in claim 1, further comprising a piece goods storage conveyor, which runs approximately parallel to the first feed conveyor in the conveying direction and which, in the conveying direction of the piece goods, is arranged downstream at the end of the first feed conveyor.

5. The apparatus as claimed in claim 1, wherein the first and second feed conveyors can be moved in cocurrent or in countercurrent in relation to each other.

6. An apparatus for inserting piece goods into containers, comprising:

a first feed conveyor for feeding the piece goods;

a second feed conveyor for feeding the containers;

a picking line for inserting the piece goods into the containers;

a control unit for controlling the relative speed between the second feed conveyor and the first feed conveyor;

at least one storage element for temporarily storing the containers and/or the piece goods, wherein the control unit controls the relative speed as a function of a filling level of the at least one storage element; and wherein the at least one storage element is a reverse conveyor which runs approximately parallel to the second feed conveyor and which conveys the containers from a removal point back to the second feed conveyor at a return point placed upstream in the conveying direction of the containers.

7. The apparatus as claimed in claim 6, wherein the at least one storage element is arranged in the area of the picking line.

8. The apparatus as claimed in claim 6, further comprising a piece goods storage conveyor, which runs approximately parallel to the first feed conveyor in the conveying direction and which, in the conveying direction of the piece goods, is arranged downstream at the end of the first feed conveyor.

9. The apparatus as claimed in claim 6, wherein the first and second feed conveyors can be moved in cocurrent or in countercurrent in relation to each other.

10. An apparatus for inserting piece goods into containers, comprising:

a first feed conveyor for feeding the piece goods;

a second feed conveyor for feeding the containers;

a picking line for inserting the piece goods into the containers;

a control unit for controlling the relative speed between the second feed conveyor and the first feed conveyor;

at least one storage element for temporarily storing the containers and/or the piece goods, wherein the control unit controls the relative speed as a function of a filling level of the at least one storage element; and wherein the at least one storage element is a container storage conveyor which runs approximately at right angles to the second feed conveyor, which conveys the containers away from a removal point from the second feed conveyor and back to this removal point again.

11. The apparatus as claimed in claim 10, wherein the at least one storage element is arranged in the area of the picking line.

12. The apparatus as claimed in claim 10, further comprising a piece goods storage conveyor, which runs approximately parallel to the first feed conveyor in the conveying direction and which, in the conveying direction of the piece goods, is arranged downstream at the end of the first feed conveyor.

13. The apparatus as claimed in claim 10, wherein the first and second feed conveyers can be moved in cocurrent or in countercurrent in relation to each other.

* * * * *